US007325548B2

(12) United States Patent
Enslin

(10) Patent No.: US 7,325,548 B2
(45) Date of Patent: Feb. 5, 2008

(54) SMOKER'S REQUISITE

(76) Inventor: George Frederick Enslin, 6 Waldorf Drive, Centurion Golf Estate, Centurion (ZA) 0002

( * ) Notice: Subject to any disclaimer, the term of this patent is extended or adjusted under 35 U.S.C. 154(b) by 593 days.

(21) Appl. No.: 10/474,373

(22) PCT Filed: Apr. 9, 2002

(86) PCT No.: PCT/IB02/01112

§ 371 (c)(1),
(2), (4) Date: Oct. 9, 2003

(87) PCT Pub. No.: WO02/080708

PCT Pub. Date: Oct. 17, 2002

(65) Prior Publication Data

US 2004/0112395 A1 Jun. 17, 2004

(30) Foreign Application Priority Data

Apr. 9, 2001 (ZA) ..... 2001/2893
May 18, 2001 (ZA) ..... 2001/4060

(51) Int. Cl.
*A24F 47/00* (2006.01)

(52) U.S. Cl. ..... 131/352; 131/347; 424/274; 424/275; 424/347; 424/352; 514/958

(58) Field of Classification Search ..... 131/274–275, 131/347, 352; 424/725; 514/958
See application file for complete search history.

(56) References Cited

U.S. PATENT DOCUMENTS 2,943,958 A * 7/1960 Schaflander ..... 131/359
3,081,777 A * 3/1963 Sipos ..... 131/339
4,124,033 A 11/1978 Zizka et al.
4,694,842 A * 9/1987 Kobayashi ..... 131/359
5,016,655 A 5/1991 Waddell et al.
5,829,449 A 11/1998 Hersh et al.
5,932,557 A * 8/1999 Mustafa et al. ..... 514/44
5,944,026 A * 8/1999 Kopsch et al. ..... 131/359
6,082,370 A 7/2000 Russo
6,776,169 B1 * 8/2004 Zou et al. ..... 131/359

FOREIGN PATENT DOCUMENTS

CN WO 99/20131 * 4/1999
FR 2420310 A * 11/1979
JP 05-115273 5/1993

OTHER PUBLICATIONS

Ames, B.N. Dietary Carcinogens and Anticarcinogens, Science, vol. 221, Sep. 23, 1983, pp. 1256-1264.*

Camellia Sinensis (L.) Kuntze, Purdue University Center for Crops & Plants Products, subtitles "Uses" and "Chemistry", [online], 1996, pp. 1-6, [retrieved on Jan. 27, 2007]. Retrieved from the Internet: <URL: http://www.hort.purdue.edu/newcrop/duke_energy/Camellia_sinensis.html>.*

Database WPI Section Ch, Week 199324 Derwent Publications Ltd., London, GB; Class D18, AN 1993-190688 XP002223128 & JP 05 115273 A (Uenoya Bikoen YG), May 14, 1993 abstract.

* cited by examiner

*Primary Examiner*—Eric Hug
*Assistant Examiner*—Dennis R. Cordray
(74) *Attorney, Agent, or Firm*—Young & Thompson

(57) ABSTRACT

A smoker's requisite embodies a substance selected from pharmaceutical products, food supplements, natural products and combinations thereof. The substance is embodied in the requisite such that, when the requisite is lit and smoked by a smoker, a quantity of the substance is ingested by the smoker.

17 Claims, No Drawings

SMOKER'S REQUISITE

This application is a 371 of PCT/IB02/01112, filed Apr. 9, 2002 and claims the benefit of South African Application Nos. 2001/2893, filed Apr. 9, 2001, and 2001/4060, filed May 18, 2001.

This INVENTION relates to a smoker's requisite.

For the purposes of this specification, a "smoker's requisite" should be understood to mean an object or device such as a cigarette or pipe which is lit and smoked by a smoker and accordingly includes, without being limited thereto, plain and filter cigarettes, pipes, cigars, cheroots and the like and the term further includes within the scope of its meaning a "smoking accessory" by which is meant an object or device which is used together with a cigarette, pipe, cigar, cheroot or the like such as a filter, cigarette holder, cigar holder or the like.

According to a first aspect of the invention there is provided a smoker's requisite which embodies a substance selected from pharmaceutical products, food supplements, natural products and combinations thereof, the substance being embodied in the requisite such that, when the requisite is lit and smoked by a smoker, a quantity of the substance is ingested by the smoker.

The substance or composition may be embodied in a component from which a smoker's requisite is made.

For example, it may be mixed with or impregnated into the tobacco of the smoker's requisite such as a cigarette or cigar prior to the manufacture of the requisite. It may be mixed with or impregnated into pipe tobacco or chewing tobacco. The substance may be crystallized or ground into a powder, dissolved or liquified prior to being mixed with or impregnated into the tobacco. A portion of a plant or a substance of the invention may be desiccated, ground, shredded or reduced to smaller particles and these particles may be incorporated into the requisite. Instead, the substance or composition may be impregnated into the paper of a cigarette or into a filter of a cigarette, cigar, pipe or the like.

The tobacco, filter or cigarette paper may be impregnated with the substance or composition by methods such as applying the substance in liquid form to the tobacco, filter or cigarette paper, by immersing the tobacco, filter, or cigarette paper in a solution of the substance, impregnating by pressure, chemically impregnating, using an adhesive, saturation, gaseous infusion, immersion, spraying, radiation, osmosis, friction, mixing, blending, infusion, coating or waxing. The substance or composition may be carried or cased in animal or plant fats or modifications of them such as tallow, palm butter, cocoa butter, synthetic fats, saccharides such as lactose, glucose or mannose or in polymers or polymeric substances such as gelatine, cellulose, polyethyleneglycol and polyvinyl alcohol. Alternatively it may be placed in or combined with calcium salts, waxes, paper, hemp, sisal, twine, water soluble materials. It may be in a membrane, sponge, sponge type matrix, porous or pumice type structure which may be rigid or flexible, porous or impervious.

In another embodiment of the invention, the particles are impregnated into the paper of the requisite by chemical impregnation using a dry or liquid chemical impregnation either during the manufacturing of the paper or during the manufacture of the requisite. For example, the substances or particles may be incorporated by mixing or blending the particles into a liquid or dry mix, which is then mixed into the pulp from which the paper or the constituents including the filter of the requisite are manufactured. Impregnation may be by soaking the paper or filter in a liquid containing the substances or extracts of the substances. Impregnation may be achieved through bonding the required substance or portions of the substance or ground or desiccated particles of the substance to the paper or filter of the requisite. This method includes bonding by pressure or the use of adhesives or bonding agents. Impregnation can also be achieved by spraying.

In other embodiments, similar methods are used to apply the substance or composition to cigar leaves.

The substance may be rolled into a filter, or form part of the filter paper or be impregnated into the filter paper. In an embodiment of the invention, the substance itself forms a filter or a part of a filter. For example, where the substance is a natural product which occurs in a plant, the filter may be constructed entirely or in part using material from the plant such as its leaf. The leaf may be used in its whole form or shredded and then shaped into a cigarette filter. The construction of the filter may then be similar to that of a conventional cigarette filter. In an embodiment of the invention the filter may be constructed entirely from the plant material or the plant material may be encased in an outer paper sheath in conventional fashion. For example, tea leaves such as green tea leaves may be rolled into a filter or may be used to make a filter.

In an embodiment of the invention, the substance or composition is sandwiched between the filter of a cigarette and the tobacco of the cigarette.

In another embodiment of the invention a carrier which carries the pharmaceutical products, food supplements, natural products or combinations thereof is incorporated or embodied in the smoker's requisite or smoking accessory. The carrier may be in the form of a cartridge, pill, package, membrane or screen which carries the substance and it may be located at any suitable position in the requisite or accessory.

For example, the cartridge or membrane may be located before, after, or in the filter. It may be placed in a smoker's requisite such as a cigarette at either end or at any point along the body of the requisite. The carrier may be refillable or rechargeable for multiple use or disposable.

The act of smoking will then cause at least some of the substance or composition to be carried with the smoke into the mouth, throat and/or lungs of the smoker and thereby cause the substance or composition to be ingested by the smoker.

The invention accordingly extends to a smoker's requisite or accessory which includes a component selected from one or more of tobacco, paper, a filter and a carrier, with a substance as described below embodied in the tobacco, paper, filter or cartridge.

It extends further to a smoker's requisite which includes a filter and in which the filter is formed from a substance as hereinbefore described.

The substance or composition may be selected from flavanols, anelgesics, anti-pyretics, anti-carcinogenic and chemo preventive agents, anti-oxidants, anxiolytics, angiogenisis inhibitors, anti-aging substances, antibiotics, antihistimines and anti-allergenics, anti-hypertensive agents, anti-inflammatories, memory and brain function treatment agents, cardiovascular and circulatory agents, diabetes treatments, anti-hypercholesterolaemics, immune system enhancers, immunizing agents, minerals, respiratory agents, sedatives, anti-stress agents, aphrodisiacs, sexual disfunction agents, enhancement drugs, tonics, stimulants and vitamins, anti-metabolites, nitrosoureas, tryptamine derivatives, proteins, steroids, vitamins and provitamins, statins, sulphonamides, substituted indoles, substituted imidazoles, metal-containing compounds, drug substances, anti-depressants, immunosuppressants, hormones, antibiotics, phytochemicals, and mixtures of any two or more thereof. Where the substance or composition comprises a mixture e.g. a mixture of natural products, such as a mixture of polyphenols, the substance or composition may comprise a portion or a combination of portions of such mixtures or a combination of such portion or portions with any of the other substances or compositions.

Where a natural substance such as a herb, plant or the like is used, the word "substance" refers to the natural or unrefined substance itself or to a partially or fully refined product produced, distilled, extracted or reduced from the substance.

The alkylating agent may be selected from alkyl sulphonates, ethyleneimine compounds and other alkylating agents. The N-mustard may, for example, be selected from chlorambucil, cyclophosphamide, melphalan, mustine and pipobroman. The alkyl sulphonate may be selected from busulphan and treosulfan. The ethyleneimine compound may be thiotepa. The alkylating agent may instead be selected from hexamethylmelamine, mitobronitol, mutolacetol and ethoglucid.

The substance may be selected from catechin, gallic acid, epigallocatechin gallate, epigallocatechin, epicatechin, epicatechin-3-gallate, epicatechin gallate, epigallocatechin-3-gallate. The tryptamine derivative may be selected from serotonin and melatonin. The protein may be selected from endostatin and angiostatin. The steroid may be selected from steroidal anti-inflammatories. It may for example be an estrogen or estrogen metabolite such as 2-methoxyestradiol.

The substance may be selected from tocopherol, alpha-tocopherol, beta-carotene, retinoic acid and ascorbic acid. The statins and compactins may be selected from lovastatin, simvastatin and pravastatin. The sulphonamide may be nimesulide. The substituted indole may be Lodine (etodolac). The metal-containing compound may be a selenium compound.

The natural product may be selected from lycopene, caffeine, prenyl flavonoids, *Camelia sinensis* and rosemary. The natural product may be of the type found in food and beverages such as the vegetables alfalfa, onions, spinach, broccoli, kale, garlic, red bell peppers and beets, fruits including bananas, red and white grapes, oranges, strawberries, kiwi fruit, grapefruit, pink grapefruit and their seeds, tomato and apple and beverages including teas from *Camelia sinensis*, apple juice, grape juice, red wine, tomato and orange, and cocoa. It may be plant substance such as Echinacea, ambrosia marijuana/cannabis/hemp or alfalfa. It may be plant material, for example plant material in its natural state from a plant having anti-carcinogenic or other medicinal properties.

The pharmaceutical product may be selected from anti-carcinogenic substances such as traodone, interferon, thalidomide, Col-3, tamoxifen, COX-2 inhibitors, celebrex, rofecoxib (vioxx), imatinib mesylate gleevec (STI 571), cyproheptadine, aspirin and paracetamol. Cyproheptadine is used as an adjunct to radiotherapy and the use of cyproheptadine may be advantageous in radiotherapy. Dosages of 200-300 mg or more of the targeted approach drugs such as C225 which is normally administered intravenously and the molecularly targeted drug such as gleevec result in blood counts in leukemia sufferers returning to normal with minimum side effects.

The anti-depressant may be selected from monoamine oxidase inhibitors such as the hydrazine derivatives, isocarboxazid, phenelzine, nialamide, iproniazid and mebanzine as well as the non-hydrazine monoamine oxidase inhibitors such as pargyline, the tricyclic anti-depressants such as dibenzazepine or zocyclohepetene derivatives such as amitriptyline, butriptyline, desipramine, clomipramine, protriptyline, nortriptyline, opipramol as well as trimipramine and iprindole which have different cyclic structures, and the tetracyclics maprotiline and mianserin.

The flavonoid may be a prenyl flavonoid of the type found in hops and beer i.e. chalcones from hops as well as prenylchalcones and prenylflavonones from naringeninand 2-hydroxy-2-methylbut-3-ene or linalool and xanthohumol from the prenylchalcone in beer.

The food supplement may be a mineral supplement such as a calcium supplement, a vitamin, tonic or stimulant.

The substance or composition may, instead, be a peroxide such as hydrogen peroxide or a synthetic anti-oxidant. The substance or composition may be a natural anti-carcinogen catsclaw, olive leaf (as well as the extract of olive leaf and olive leaf concentrate), pau-d'arco, mistletoe (also sold as iscar and iscador) or cartilage including shark cartilage.

The substance may be selected from the substances and formulations set out in Tables 1 and 2. The amounts of the substance or substances embodied in a smoker's requisite or smoking accessory may be between the lower value as set out in column A of Table 1 and the higher value as set in column C of Table 1 or the amount set out in column C of Table 2. More particularly, the amounts may be as set out in column A of Table 1. Preferred amounts are set out in column B of Table 1 or column D of Table 2. Column C also represents the maximum and minimum daily dose of the relevant substance.

The invention extends to a carrier which is shaped and dimensioned to be received in a smoker's requisite or accessory selected from cigarettes, cigars, cigarette holders, cigar holders and removable filters which incorporates a substance selected from pharmaceutical products, food supplements, natural products and combinations thereof, the substance being incorporated in the requisite such that, when the requisite is lit and smoked by a smoker, a quantity of the substance is ingested by the smoker.

The carrier may be a package, cartridge, pill, sponge, matrix, filter, porous membrane, tablet or string and may have any suitable shape. It may for example be cylindrical, round, rectangular, square, spherical, tubular or coin shaped. It may be manufactured as a polymeric tube and may be porous, impervious flexible or rigid. It may be a porous or perforated tube which may extend axially down the centre of a cigarette.

The substance may be incorporated into the requisite by manufacturing and configuring it in the form of a string and may be placed or inserted into the requisite or placed on the outside of the requisite. The substance may be impregnated into the string by various methods including use of adhesives, bonding agents, or by soaking, gaseous infusion, immersion, spraying, friction, glueing, impregnation by pressure, sealing, coating or waxing. The string, containing the required substance or plant, may contain binding materials or inert materials to hold or bind the substances together in the form of a string. If the substance to be incorporated is in dry powder, crystalline or granular form the string may be coated with a coating such as wax or fat such as bees wax or cocoa butter to bond the substance or powder. Alternatively, the string may be manufactured partially or wholly from or with the substance to be incorporated into the smoker's requisite.

The carrier provides insulation of the substance and protects it from oxidation, or destruction and to regulate the heat so as to regulate and control release of the substance (i.e. quantity and timing). This string may be stored or coiled into rolls from which lengths as required may be placed into the smoker's requisite at the time of manufacture of the smoker's requisite. Instead, the substance may be impregnated into or embodied in a prior made string. The substance may, instead, be embodied in a band of paper or similar material.

The bands may be applied onto or wrapped around the requisite or may be formed in the paper as an integral part of the paper from which the cigarette is manufactured. The required substance is then carried by the paper and forms an integral part of the cigarette paper. The incorporation or manufacture of the various bands may be done at the time of manufacture of the cigarette paper. These bands may be applied in ring form around the diameter of the smoker's requisite e.g. a cigarette or cigar in lengths which may be straight or otherwise along the length of the cigarette. These bands may also be applied to the cigarette in various patterns including coiled, spiral, in wave form along the length of the cigarette, in zigzag pattern and various other patterns.

The invention extends further to a smoking accessory selected from cigarette holders, cigar holders and detachable filters which incorporates a substance selected from pharmaceutical products, food supplements, natural products and combinations thereof.

It extends further to a method of making a smoker's requisite which embodies a substance selected from pharmaceutical products, food supplements, natural products and combinations thereof, which includes combining a component of a smoker's requisite with the substance and using the component to make the requisite.

The invention extends, further, to a method of administering to a person a substance selected from pharmaceutical products, food supplements, natural products and combinations thereof which includes the step of incorporating the substance in a smoker's requisite as hereinbefore described so that, when the smoker's requisite is smoked by a person, an amount of the substance or composition is ingested by the person during smoking.

The invention extends further to a method of administering to a person a substance selected from pharmaceutical products, food supplements, natural products and combinations thereof which includes the step of incorporating the substance in a smoking accessory as hereinbefore described so that, when the smoking accessory is used together with a smoker's requisite, an amount of the substance is ingested by the person during smoking.

According to another aspect of the invention, there is provided a method of making a smoker's requisite which embodies a substance selected from pharmaceutical products, food supplements, natural products and combinations thereof, which includes incorporating a carrier which carries the substance in the smoker's requisite so that when the requisite is lit and smoked by a smoker, a quantity of the substance is ingested by the smoker.

The substance may be a combination of one or more of the pharmaceutical products, food supplements and natural products.

In preferred embodiments of the invention the substance or composition comprises, in combination, novastatin and Lodine or in combination a statin such as mevacor (lovastatin) and a COX-2 inhibitor such as celebrex, vioxx or nimesulide or in combination mevacor (lovastatin) and Lodine XL. In another preferred embodiment of the invention the substance or composition comprises mycopene, a selenium compound and green tea. In another preferred embodiment the substance or composition comprises epigallocatechin-3-gallate, epigallocatechin, epicatechin gallate and/or epicatechin-3-gallate. In another preferred embodiment the substance or composition is a combination of epigallocatechin gallate and curcumin. A combination of catechins is better than epigallocatechin gallate alone for producing cell apoptosis. The effect is synergistically increased when catechins are combined with other anti-carcinogenic substances such as tamoxifen. In another preferred embodiment a seratonin antagonist such as periactin (cyproheptadine) can be used alone or in conjunction with melatonin. A dosage of 36 mg of melatonin daily as an adjuvant in conjunction with traditional cancer treatments reduces the side effects of toxic therapies and increases their effectiveness.

An anti-carcinogenic substance, for the purposes of this specification, is a substance which acts against cancer in a prophylactic fashion or is a substance which can be used in the treatment of cancer, for example in a chemotherapeutic fashion.

The smoking of a smoker's requisite or the use of a smoking accessory as hereinbefore described incorporating extracts of *Camelia sinensis* results in the ingestion of epigallocatechin gallate. This compound has been shown to be active amongst others against colon cancer, melanoma, breast cancer and lung cancer.

In order to inhale and ingest the various compounds and substances of the invention, certain of these have to be broken down, diffused or vapourised so that they can be transported into the draught or flow of air and smoke being drawn in by the smoker or diffused and released into the atmosphere where it could be breathed by a passive smoker.

Heat generated by the glowing end of a cigarette, will gradually permeate along the length of the cigarette. The resulting increase in temperature, depending upon the substance or composition used, will allow or cause the substance or composition to be progressively released and inhaled by the smoker. Different substances will be released at different temperatures. The end of a cigarette which is closest to the user when being smoked will initially be cooler than the opposite end and will gradually increase in temperature as the cigarette is smoked. The release of the substances is optimised by the positioning of the substances in the requisite. With certain substances that are more sensitive to heat or require only a small amount of heat to release them or their required active ingredient, the substance is placed at the end of the requisite closest to the smoker's mouth. At this end, the substance is not immediately subjected to the extreme heat generated at the lit end. This preserves the integrity of the substance for a longer period. The substance is then subjected to a gradual increase in temperature as the lit end approaches the area where the substance has been placed. The rise in temperature and/or the air drawn through the cigarette causes the active ingredients to be released. The constituents so released are then be ingested by the person smoking the requisite.

The substance or composition may be placed along the length of the cigarette or at any point where it will reach the optimal temperature for the optimal period of time. This would be predetermined before manufacture by taking into account which substance is to be used and may be determined by routine experimentation.

The cigarette or cigar holder may be openable by a flip, screw, bayonet taper or push-in mechanism and an anti-carcinogenic package, food supplement package, medication package or anti-depressant package, filter or membrane may be receivable in the accessory. The holder may be attachable to a cigarette or cigar by a push, taper or friction fit.

The invention extends to an anti-carcinogenic cartridge which can be inserted into a cigarette holder, cigar holder or pipe.

For purposes of this specification the words "substance-"and "material" include any compound, mixture, blend, medication, formula, drug (synthetic or natural), hormone, plant, seed, pollen, flower, vegetable, fruit or bio-organism and includes the above in their natural, organic or synthetic form or a derivative or modification of any of them and when used in their whole, part, refined or unrefined form or only a portion or any constituent of, extract, fraction, molecule or distillate derived from any of the above or a portion of the aforegoing (extract) in its refined or unrefined form or a synthetically manufactured derivative or substitute of any of the aforegoing. Any of these may be used individually or in combination with each other or with other remedies, formulae or substances.

The mass and bulk of some of the formulae of this invention require that the formulation be carried in a cartridge which is inserted into a filter which is detachable from the cigarette. The detachable filter may be pre-packed with a substance of medication and may be in the form of a disposable single use filter or it may be used until the medication or substance is depleted. Alternatively the filter may be in a form where it may be re-used in which instance a fresh cartridge/carrier is inserted.

The filter is pushed onto the end of the requisite which may be filterless or already have a filter and may be held in place by a ringed sleeve which can be rigid or flexible.

The medication may then be incorporated into the filter by one of the methods described above or by the insertion of the "carrier".

The medication can also be incorporated by the insertion of a porous membrane which carries the medication.

A non-porous membrane may be used behind which the medication is packed or stored. The medication may be sandwiched between two membranes or between a membrane and the tobacco portion of the requisite. Alternatively the medication may be carried or housed in a cartridge through which the smoke from the burning tobacco can pass. The cartridge may have a porous or non-porous membrane on one or both sides through which the smoke can pass.

The cartridge or carrier may be made from porous paper, material, or cellulose. When the detachable filter is forced onto the end of the requisite the membrane is pierced and the medication is exposed to the draught/flow of air which passes from the lit end of the requisite to the smokers mouth. The non-porous membrane may also be impregnated with a medication.

The cartridge or insert which is incorporated in the smoker's requisite or accessory protects the integrity of the active ingredients incorporated into the requisite or accessory both during the time the requisite is in storage and during the time it is being consumed and can reduce the temperature to which the substance is exposed during the smoking of the requisite and further allow for the pre-positioning of the substance within the requisite so that the timing of the release and the amount of the substance may be predetermined and controlled. The use of a cartridge or insert to incorporate any particular substance in a smoker's requisite allows easier incorporation of the substance during the manufacturing process. The use of a cartridge or insert allows easier substitution of alternate substances or medications to be incorporated into a requisite without major changes to the manufacturing process when a change of the substance is required.

To regulate the amount of active ingredient or substance released during the smoking of the requisite, the cartridge or insert may be rigid or flexible and may be porous. The degree of porosity may also be varied to determine the amount of air or smoke which passes through it. The draught of air or smoke passing through the insert or cartridge assisted by the heat, releases the active ingredient of the substance in the cartridge.

In addition to air or smoke passing through a selected substance or cartridge or insert, the active ingredients may be dispensed or released by air, smoke or heat passing over or around the substance, the cartridge or insert.

Alternatively the active ingredients can be released or diffused at the time that the cartridge or insert heats up or is burnt. When using this method the cartridge or insert may be of a non-porous or semi-porous nature.

More than one cartridge may be incorporated into a smoker's requisite. The content, make up and construction of the various cartridges may differ from each other and more than one type of cartridge or insert may be incorporated into a smoker's requisite.

The insert or cartridge carries the substance and dispenses or infuses the substance into the requisite either before or during the igniting and combustion of the smoker's requisite. Such infusion or dispensing into the requisite can be achieved by way of diffusion. The cartridge or insert may also be manufactured from a porous material or a porous membrane so that the substance can diffuse through the walls of the cartridge or insert. Alternatively dispensing or diffusion can be achieved by holes or perforations in the cartridge or insert.

The dosage or amount of substance delivered to the smoker can be varied by increasing or decreasing the quantity and size of cartridges incorporated into the requisite or increasing or decreasing the amount of string incorporated into the requisite or by varying the porosity of the insert or cartridge or by increasing the number or size or perforations in the insert or cartridge.

Instead the substance may be placed at any point in the requisite. The substance may be housed in a cavity or pocket anywhere in the requisite or in a cavity or pocket sandwiched between the filter and the section of the requisite containing the tobacco or within a cavity or pocket either in the tobacco portion or filter portion of the requisite or combined in the paper or glue.

In another embodiment of the invention, the substance in a desiccated, shredded or ground state may be blended into an inert carrier, which is then placed into the requisite or filter. The inert carrier, which encases the substance is selected so as to release the substance or the active material from the substance at a predetermined temperature and to protect the integrity of the substance from excessive heat until it can be ingested or inhaled by the smoker.

Another method of incorporation is to fold or roll the particles into the filter at the time of manufacture of the filter.

Another method of incorporation is to blend or mix the particles into the tobacco mix.

In yet another embodiment, the substance is incorporated into the filter of the requisite. The substance may be incorporated by rolling, folding or impregnating it into the filter or filter paper.

In yet another embodiment the *Camellia sinensis* or rosemary plant or certain of the constituents of the *Camellia sinensis* or rosemary plant or a combination of the plants may be incorporated into the body of the requisite where the tobacco is housed or used as described above.

In yet another embodiment, the process and method used in the manufacture of a conventional cigarette filter is employed using material selected from a plant.

In yet another embodiment the plant material may be incorporated into a filter made from the materials and according to the process employed in the manufacture of a conventional cigarette filter.

In yet another embodiment portions of the plant material are placed in a porous cartridge which is then incorporated into the smoker's requisite.

Naturally, more than one of the substances can be used in a single smoker's requisite or accessory.

The invention is now described, by way of example, with reference to the following Examples.

EXAMPLE 1

Mevacor (lovastatin) and Lodine XL were combined with cigarette tobacco and formed into a cigarette. The amount of Mevacor (lovastatin) incorporated was 50 mg and the amount of Lodine XL was 4 mg. The preferred daily dosage of lovastatin is 1000 mg and that of Lodine XL 80 mg per day.

EXAMPLE 2

Cyproheptadine was mixed with cigarette tobacco and the tobacco was formed into a cigarette. The amount of cyproheptadine incorporated was 0,2 mg. The preferred daily dosage of Cyproheptadine is 4 mg. The daily intake of Cyproheptadine may vary between 4-12 mg.

EXAMPLE 3

Melatonin was mixed with cigarette tobacco and the tobacco was formed into a cigarette. The amount of melatonin incorporated was 1,8 mg. The preferred daily dosage of melatonin is 36 mg. The daily intake of melatonin may vary between 3-200 mg.

EXAMPLE 4

Tamoxifen was mixed with cigarette tobacco and the tobacco was formed into a cigarette. The amount of tamoxifen incorporated was 1 mg. The preferred daily dosage of tamoxifen is 20 mg. The daily intake of tamoxifen may vary between 10-40 mg.

EXAMPLE 5

A formulation consisting of 1,8 mg of Melatonin and 0,2 mg Cyproheptadine was mixed with cigarette tobacco and the tobacco was formed into a cigarette.

EXAMPLE 6

Cyproheptadine was mixed with cigarette tobacco and the tobacco was formed into a cigarette. The amount of cyproheptadine was selected so that, by smoking a predetermined number of cigarettes per day, a dose of 4 mg of the cyproheptadine was delivered to a smoker.

EXAMPLE 7

Flavonols were mixed with cigarette tobacco and the tobacco was formed into a cigarette. The amount of flavanols incorporated was 25 mg. The preferred daily dosage of flavanols is 20 mg. The daily intake of flavonols may vary between 10-1000 mg.

EXAMPLE 8

Endostatin was mixed with cigarette tobacco and the tobacco was formed into a cigarette. The amount of endostatin incorporated was 15 mg. The preferred daily dosage of endostatin is 300 mg. The daily intake of indostatin may vary between 3,75-600 mg.

EXAMPLE 9

Melatonin and Cyproheptadine were combined with cigarette tobacco and formed into a cigarette. The amount of Melatonin incorporated was 1,8 mg and the amount of Cyproheptadine was 0,2 mg. The preferred daily dosage of malatonin is 36 mg and that of Cyproheptadine is 4 mg per day. The daily intake of Melatonin may vary between 3-200 mg per day and that of Cyproheptadine 4-12 mg per day.

EXAMPLE 10

The procedure of Examples 1 and 2 was followed but the active ingredients were impregnated into the paper of the cigarette.

EXAMPLE 11

Plant material extracted from the *Camellia sinensis* and rosemary plant were cut, blended and rolled into the form of a string. An inert tasteless binding agent was used to hold the string together. This string was coiled onto a core or spindle for storage and ease of handling. From this coil a length was cut and inserted into a cigarette at the time of manufacture. In use, when the cigarette was smoked, the string burned gradually down the length of the cigarette. The plant material gradually released its active ingredients as the string burned. The string was subjected to an increasing temperature from ambient gradually rising along the length of the string as the burning end of the cigarette proceeded down the length of the cigarette. The progressive increase in temperature allowed the string to release its active components. The components were ingested by the smoker by inhalation.

EXAMPLE 12

Example 11 was repeated but instead of arranging the string linearly along the length of the cigarette it was coiled cylindrically along the cigarette close to the outer paper. In this embodiment the dosage and delivery of the active ingredient was increased as more string containing the active ingredient was incorporated into the cigarette than was incorporated in Example 4.

EXAMPLE 13

Example 11 was repeated but the string was coiled in a smaller diameter coil down the approximate centre line of the cigarette along its length.

EXAMPLE 14

Example 11 was repeated and in this case a tightly compressed coil of string configured in the shape of a watch spring but more tightly wound was incorporated and sandwiched between the filter and tobacco of the requisite.

EXAMPLE 15

Example 11 was repeated several more times and active ingredient in each example was varied by altering the configuration in which the string was incorporated into the requisite. When the string was tightly coiled with the coils being closely spaced to each other, the amount of string in relation to the length of the requisite was increased resulting in a higher concentration of active ingredient per length of requisite. The dosage and delivery rate was altered by either using a loosely wound spaced coil, which resulted in a lower concentration of active ingredient per length of requisite or a tightly wound spaced coil which provided a higher concentration and consequently a higher dosage. To obtain variation in the amount of active ingredient delivered the string was incorporated into the cigarette in various configurations including coiling, zigzagging, straight lengths, wave pattern, rings, individual rings, linked rings, joined looped rings, U-shape, linked U-shape patterns as well as watch spring and Catherine Wheel type patterns.

In one embodiment, the string coil was wound on the outside of the cigarette along its length. In another embodiment, a tightly compressed coil was placed in the filter section of the cigarette. In another embodiment, more than one coil was used and interspersed through the filter of the cigarette. In another embodiment, the coil was placed in the tobacco section of the cigarette. In another embodiment, more than one coil was used and these were placed in the filter section as well as the tobacco section of the cigarette. In another embodiment, more than one coil was used and these were placed in the filter section as well as the tobacco section of the cigarette.

EXAMPLE 16

1000 mg of the analgesic Paracetamol in powder form was encased in a porous cylindrical hollow barrel type cartridge which was then placed longitudinally into a cigarette.

EXAMPLE 17

A porous cartridge was manufactured in which a mix of *Epigallocatechin gallate* (25 mg) and curcumim (37,5 mg) were placed. This was incorporated in a cigarette directly in front of the filter so that it was sandwiched between the filter and the tobacco of the cigarette.

EXAMPLE 18

Example 10 was repeated and the cartridge was placed in the filter portion of the cigarette.

EXAMPLE 19

A filter for a cigarette was manufactured in which a mixture of *Epigallocatechin gallate* (25 mg) and curcumin (37,5 mg) from turmeric was impregnated into the filter material. This filter was then used in the manufacture of a smoker's cigarette.

EXAMPLE 20

A filter for a cigarette was manufactured using parts of the *Camellia sinensis* plant and incorporating these into the filter by rolling and folding strips and portions of the plant into the filter paper.

EXAMPLE 21

Example 20 was repeated four more times with the following changes.

In one embodiment, the plant material was ground and lodged in the filter during the manufacture of the filter.

In another embodiment, the constituent parts of the *Camellia sinensis* plant were bonded to the filter paper prior to the manufacture of the filter.

In another embodiment, the constituent parts were made to adhere to the filter paper by using pressure to impress these into the paper.

In another embodiment, the constituents of the *Camellia sinensis* plant were bonded to the filter paper using bonding material which would not adversely affect the taste of the cigarette when this was smoked.

EXAMPLE 22

A filter was constructed using large unrefined sections of the *Camellia sinensis* plant which were processed and rolled to form a filter.

EXAMPLE 23

Example 22 was repeated but the *Camellia sinensis* plant was shredded into smaller sections, before being rolled into the shape of a filter.

EXAMPLE 24

Example 22 was repeated using shredded sections of the *Camellia sinensis* plant.

EXAMPLE 25

A cigarette was made using a blend of shredded *Camellia sinensis* plant and tobacco.

EXAMPLE 26

Plant material selected from the plant materials of the invention were finely ground and then compacted and tightly packed in a porous cartridge which was then incorporated into a cigarette directly in front of the filter. This cartridge was held in place by being sandwiched between the filter and the tobacco of the requisite.

EXAMPLE 27

Example 26 was repeated several times but the cartridges were placed at various points within the length of the tobacco portion of the cigarette.

EXAMPLE 28

Example 26 was repeated but the cartridge was placed in the filter.

EXAMPLE 29

Example 26 was repeated but more than one cartridge was placed in the tobacco section and in the filter of the cigarette.

EXAMPLE 30

Pulp from grapefruit was desiccated and ground to around 60/100 mesh. Seeds from the grapefruit were dried and ground to around 60/100 mesh. The pulp and seed particles were blended and 50 ml of this blend was mixed into a tobacco mix from which a cigarette was manufactured. This provides protection for humans against mosquito and mosquito related diseases such as malaria.

EXAMPLE 31

In further embodiments, the blend was impregnated into the filter or the cigarette paper or incorporated into a string and used as in Examples 4-8 or incorporated into a porous cartridge and used as in Examples 20-23.

EXAMPLE 32

Pulp from grapefruit was desiccated and ground to around 60/100 mesh. Seeds from the grapefruit were dried and ground to around 60/100 mesh. The pulp and seed particles were blended and 50 mg of this blend was added to 55 mg of *artemisia annua* and 10 mg of berberine. This mix was mixed into tobacco from which a cigarette was manufactured.

EXAMPLE 33

Examples 11-29 were repeated using the blend of Example 32.

It is an advantage of the invention illustrated that, in the case of a person who is smoking or addicted to smoking, the incorporation of an anti-carcinogenic compound in a cigarette, or in pipe tobacco or the like should serve to reduce or possibly prevent the incidence of cancer which can be caused through smoking. It is also an advantage of the invention illustrated that, where a person has contracted, for example, lung cancer through smoking but nevertheless refuses to stop smoking, the method of the invention can be used to dose the person with a chemotherapeutic agent to treat the cancer. It is also an advantage of the invention illustrated that the invention may be used to provide nutrition, food supplements, drugs, vitamins, remedies or medications to a smoker who may not have cancer.

TABLE 1

| | Name/Substance/ Compound/Active Ingredient | A | B | C | D |
|---|---|---|---|---|---|
| FORMULA | Methylsulphonylmethane (MSM) | | | | 500 mg |
| | Pycnogenol | | | | 60 mg |
| | Epigallocatechin gallate (EGCg) | | | | 500 mg |
| | D-alpha tocopheryl succinate | | | | 100 mg |
| | | 0.058-87 mg | 58 mg | 116-1740 mg | 1160 mg |
| FORMULA | Selenium | | | | 100 mcg |
| | Pine bark extract | | | | 100 mg |
| | Grapeseed extract | | | | 100 mg |
| | Epigallocatechin gallate (EGCg) | | | | 500 mg |
| | D-alpha tocopheryl succinate | | | | 100 mg |
| | | 4-60 mg | 40.0 mg | 80-1200.15 mg | 800.1 mg |
| FORMULA | Beta carotene | | | | 15 mg |
| | Cryptoxanthin | | | | 0.025 mg |
| | Alpha carotene | | | | 0.1 mg |
| | Zeaxanthin | | | | 0.02 mg |
| | Lutein | | | | 10 mg |
| | Lycopene | | | | 10 mg |
| | Epigallocatechin gallate (EGCg) | | | | 500 mg |
| | *Vaccinium myrtillus* | | | | 60 mg |
| | | 2.98-44.64 mg | 29.7 mg | 59.51-892.71 mg | 595.14 mg |
| | Gamma-Aminobutyric Acid | 50-200 mg | 75 mg | 1-4 g | 1.5 g |
| | Piper methysticum Standardized Extract (30%-70% kavalactones) | 5-35 mg | 15 mg | 100-700 mg | 300 mg |
| | *Scutellaria lateriflora* | 50-150 mg | 50 mg | 1-3 g | 1 g |
| FORMULA | Piper methysticum Standardized Extract (30%-70% kavalactones) | | | | 300 mg |
| | Gamma-Aminobutyric Acid | | | | 1.5 mg |
| | *Eleutherococcus senticosus* | | | | 1000 mg |
| | | 6.51-97.61 mg | 65.08 mg | 130.1-1952.25 mg | 1301.5 mg |
| FORMULA | *Crataegus oxycanthus* | | | | 1500 mg |
| | Coenzyme Q10 | | | | 50 mg |
| | *Leonurus cardiaca* | | | | 500 mg |
| | *Lycopus virginicus* | | | | 100 mg |
| | epigallocatechin gallate (EGCg) | | | | 500 mg |
| | | 26.5-172.5 mg | 132.5 mg | 530-3450 mg | 2650 mg |
| | *Hypericum perfoliatum* (as standarized extract of 0.3% Hypericin) | 15-45 mg | 45 mg | 300-900 mg | 900 mg |

TABLE 1-continued

| | Name/Substance/ Compound/Active Ingredient | A | B | C | D |
|---|---|---|---|---|---|
| | 5-Hydroxy-tryptophan (as seed extract of *Griffonia simplificolia*) | 15-30 mg | 5 mg | 300-600 mg | 100 mg |
| | *Lavandula officinalis* | 0.1-0.2 ml | 0.15 ml | 2-4 ml | 3 ml |
| | *Sterculia acuminata* | 0.1-0.6 ml | 0.15 ml | 2-12 ml | 3 ml |
| | *Panax* Ginseng | 25-150 mg | 50 mg | 0.5-3 g | 1000 mg |
| | *Eleutherococcus senticosus* | 10-150 mg | 50 mg | 200-3000 mg | 1000 mg |
| | *Panax quinquefolius* | 25-150 mg | 50 mg | 0.5-3 g | 1000 mg |
| | *Strychnos ignatii* | 0.03-0.15 ml | 0.05 ml | 0.6-3 ml | 1 ml |
| | *Turnera diffusa* | 0.1-0.2 ml | 0.15 ml | 2-4 ml | 3 ml |
| | *Rhodiola rosea* | 0.025-0.15 ml | 0.075 ml | 0.5-3 ml | 1.5 ml |
| | *Urtica urens* | 0.1-0.6 ml | 0.25 ml | 2-12 ml | 5 ml |
| | *Euphrasia officinalis* | 0.1-0.6 ml | 0.25 ml | 2-12 ml | 5 ml |
| | Ephedra (Ma Huang 1:4 Ø) | 0.125-0.375 ml | 0.25 ml | 2.5-7.5 ml | 5 ml |
| FORMULA | Ephedra (Ma Huang 1:4 Ø) | | | | 500 mg |
| | *Euphrasia officinalis* | | | | 500 mg |
| | Ascorbic acid | | | | 500 mg |
| | | 7.55-112.5 mg | 75 mg | 150-2250 mg | 1500 mg |
| FORMULA | *Achillea millefolium* | | | | 5 ml |
| | *Viscum album* | | | | 1 ml |
| | *Taraxacum officinale* | | | | 4 ml |
| | *Tilia platyphyllos* | | | | 4 ml |
| | *Allium sativum* | | | | 1 ml |
| | | 0.075-1.125 ml | 0.75 ml | 1.5-22.5 ml | 15 ml |
| FORMULA | *Achillea millefolium* | | | | 5 ml |
| | *Viscum album* | | | | 1 ml |
| | *Taraxacum officinale* | | | | 4 ml |
| | *Tilia platyphyllos* | | | | 4 ml |
| | *Valeriana officinalis* | | | | 5 ml |
| | *Scutellaria lateriflora* | | | | 4 ml |
| | | 0.115-1.725 ml | 1.15 ml | 2.3-34.5 ml | 23 ml |
| | Glucosamine sulphate | 12.5-75 mg | 75 mg | 250-1500 mg | 1500 mg |
| | Chondroitin sulphate | 5-25 mg | 25 mg | 100-500 mg | 500 mg |
| | Curcumin | 12.5-50 mg | 12.5 mg | 250-1000 mg | 250 mg |
| | *Salix alba* | 50-100 mg | 12.5 mg | 1000-2000 mg | 250 mg |
| | *Tanacetum parnethium* | 12.5-75 mg | 12.5 mg | 250-1500 mg | 250 mg |
| | Methylsulphonylmethane (MSM) | 5-50 mg | 25 mg | 100-1000 mg | 500 mg |
| | *Boswellia serrata* | 0.5-25 mg | 12.5 mg | 10-500 mg | 250 mg |
| FORMULA | Glucosamine sulphate | | | | 1500 mg |
| | Chondroitin sulphate | | | | 500 mg |
| | Curcumin | | | | 250 mg |
| | *Salix alba* | | | | 250 mg |
| | *Tanacetum parnethium* | | | | 250 mg |
| | Methylsulphonylmethane (MSM) | | | | 500 mg |
| | *Equisetum arvensis* | | | | 50 mg |
| | Copper lysinate | | | | 1 mg |
| | Zinc glycinate | | | | 10 mg |
| | Manganese sulphate | | | | 2 mg |
| | Chelated Selenium | | | | 0.1 mg |
| | Epigallocatechin gallate (EGCg) | | | | 500 mg |
| | | 19.07-285.98 mg | 190.66 mg | 381.3-5719.65 mg | 3813.1 mg |
| FORMULA | Glucosamine sulphate | | | | 1500 mg |
| | Chondroitin sulphate | | | | 500 mg |
| | Curcumin | | | | 250 mg |
| | *Boswellia serrata* | | | | 250 mg |
| | Epigallocatechin gallate (EGCg) | | | | 500 mg |
| | Methylsulphonylmethane (MSM) | | | | 500 mg |
| | Epigallocatechin (EGC) | | | | 200 mg |
| | Pycnogenol | | | | 60 mg |
| | | 18.8-282 mg | 188 mg | 376-5640 mg | 3760 mg |
| | Epigallocatechin gallate (EGCg) | 5-125 mg | 25 mg | 100-2500 mg | 500 mg |
| | Epicatechin gallate (ECG) | 75-750 mg | 150 mg | 1.5 g-15 g | 3 g |
| | Epigallocatechin (EGC) | 75-750 mg | 150 mg | 1.5 g-15 g | 3 g |
| | Gallocatechin gallate (GCG) | 75-750 mg | 150 mg | 1.5 g-15 g | 3 g |
| | Gallocatechin (GC) | 75-750 mg | 150 mg | 1.5 g-15 g | 3 g |
| | Epicatechin (EC) | 75-750 mg | 150 mg | 1.5 g-15 g | 3 g |
| | Catechin (C) | 75-750 mg | 150 mg | 1.5 g-15 g | 3 g |
| | Epigallocatechin-3-gallate | 5-125 mg | 25 mg | 100-2500 mg | 500 mg |
| | Epicatechin-3-gallate | 75-750 mg | 150 mg | 1.5 g-15 g | 3 g |
| FORMULA | Epigallocatechin gallate (EGCg) | | | | 500 mg |
| | Epicatechin (EC) | | | | 3000 mg |

TABLE 1-continued

| | Name/Substance/ Compound/Active Ingredient | A | B | C | D |
|---|---|---|---|---|---|
| | Epicatechin gallate (ECG) | | | | 3000 mg |
| | Epigallocatechin (EGC) | | | | 3000 mg |
| | d-alpha tocopheryl acetate | | | | 100 mg |
| | Ascorbic acid | | | | 250 mg |
| | | 49.25-738.75 mg | 492.5 mg | 985-14775 mg | 9850 mg |
| | *Gingko biloba* (Standard extract) | 0.5-12 mg | 6 mg | 10-240 mg | 120 mg |
| | *Hydrocotyle asiatica* | 5-30 mg | 15 mg | 100-600 mg | 300 mg |
| | Dimethylaminoethanol Bitartrate (DMAE) | 5-20 mg | 10 mg | 100-400 mg | 200 mg |
| | Rivastigamine | 0.075-0.3 mg | 0.3 mg | 1.5-6 mg | 6 mg |
| FORMULA | *Gingko biloba* (Standard extract) | | | | 120 mg |
| | *Hydrocotyle asiatica* | | | | 300 mg |
| | Dimethylaminoethanol Bitartrate (DMAE) | | | | 200 mg |
| | Chromium GTF | | | | 100 mcg |
| | Thiamine hydrochloride | | | | 20 mg |
| | Riboflavin | | | | 20 mg |
| | Nicotinamide or Niacinamide | | | | 20 mg |
| | Calcium d-Pantothenate | | | | 20 mg |
| | Phosphatidyl Choline | | | | 50 mg |
| | | 3.76-56.26 mg | 37.5 mg | 75.1-1125.15 mg | 750.1 mg |
| | *Trigonella foenum-graecum* | 5-100 mg | 10 mg | 0.1 g-2 g | 200 mg |
| | *Oplopanax horridum* | 0.1-0.6 ml | 0.2 ml | 2-12 ml | 4 ml |
| | *Phaseolus vulgaris* | 0.1-0.6 ml | 0.2 ml | 2-12 ml | 4 ml |
| | *Vaccinium myrtillus* | 0.1-0.6 ml | 0.2 ml | 2-12 ml | 6 ml |
| FORMULA | *Trigonella foenum-graecum* | | | | 3 ml |
| | *Oplopanax horridum* | | | | 4 ml |
| | *Phaseolus vulgaris* | | | | 4 ml |
| | *Vaccinium myrtillus* | | | | 6 ml |
| | | 0.085-1.275 ml | 0.85 ml | 1.7-25.5 ml | 17 ml |
| | *Echinacea purpurea* | 2.5-150 mg | 150 mg | 50-3000 mg | 3000 mg |
| | *Olea europea* extract Containing 12% Oleuropein | 25-50 mg | 50 mg | 500-1000 mg | 1000 mg |
| | *Astragalus mebricanaceus* root | 12.5-1500 mg | 75 mg | 0.25-30 g | 1.5 g |
| | *Hydrastis canadensis* root | 12.5-150 mg | 150 mg | 250-3000 mg | 3000 mg |
| | *Allium sativa* | 12.5-1500 mg | 250 mg | 0.25-30 g | 5 g |
| | *Calendula officianalis* | 50-100 mg | 75 mg | 1-2 g | 1.5 g |
| FORMULA | *Echinacea purpurea* | | | | 3000 mg |
| | *Hydrastis canadensis* root | | | | 3000 mg |
| | *Astragalus mebricanaceus* root | | | | 1500 mg |
| | | 0.038-0.56 g | 0.38 g | 0.75-11.25 g | 7.5 mg |
| FORMULA | *Sambucus canadensis* | | | | 2 g |
| | *Echinacea purpurea* | | | | 3000 mg |
| | *Hydrastis canadensis* root | | | | 3000 mg |
| | *Allium sativa* | | | | 5 g |
| | | 0.065-0.975 g | 0.65 g | 1.3-19.5 g | 13 g |
| FORMULA | *Artemesia annua* | | | | 750 mg |
| | Berberine | | | | 150 mg |
| | Grapefruit seed extract | | | | 750 mg |
| | *Allium sativa* | | | | 2500 mg |
| | | 20.75-311.25 mg | 207.5 mg | 415-6225 mg | 4150 mg |
| | *Sambucus nigra* | 0.1-0.6 ml | 0.3 ml | 2-12 ml | 6 ml |
| | *Achillea millefolium* | 0.1-0.6 ml | 0.3 ml | 2-12 ml | 6 ml |
| | *Mentha piperita* | 0.1-0.6 g | 0.25 g | 2-12 g | 5 g |
| FORMULA | Triprolidine HCl | | | | 3.75 mg |
| | Pseudoephedrine HCl | | | | 90 mg |
| | Ascorbic acid | | | | 1500 mg |
| | *Echinacea purpurea* | | | | 1.5 g |
| | | 7.98-119.64 mg | 79.76 mg | 159.53-2392.88 mg | 1595.25 mg |
| FORMULA | Lecithin | | | 10-5000 mg | 500 mg |
| | Nicotinic acid | | | 1-1500 mg | 100 mg |
| | Chromium polynicotinate | | | 0.01-0.3 mg | 0.2 mg |
| | *Allium sativa* | | | 10-5000 mg | 500 mg |
| | *Dioscorea villosa* | | | 100-3000 mg | 1000 mg |
| | DHEA | | | 10-150 mg | 50 mg |
| | | 21.5-140 mg | 107.51 mg | 430-2800 mg | 2150.2 mg |
| | *Althea officinalis* | 0.1-0.75 ml | 0.25 ml | 2-15 ml | 5 ml |
| | *Angelica archangelica* | 0.1-0.6 ml | 0.2 ml | 2-12 ml | 4 ml |
| | *Cephaelis ipecacuanha* | 0.0125-0.15 ml | 0.05 ml | 0.25-3 ml | 1 ml |

TABLE 1-continued

| | Name/Substance/ Compound/Active Ingredient | A | B | C | D |
|---|---|---|---|---|---|
| | *Plantago lanceolata* | 0.1-0.6 ml | 0.25 ml | 2-12 ml | 5 ml |
| | *Thymus vulgaris* | 0.1-0.6 ml | 0.2 ml | 2-12 ml | 4 ml |
| | *Salvia officinalis* | 0.05-0.6 ml | 0.2 ml | 1-12 ml | 4 ml |
| | *Commiphora myrrha* | 0.1-0.75 ml | 0.25 ml | 2-15 ml | 5 ml |
| | *Drosera* spp. | 0.025-0.15 ml | 0.05 ml | 0.5-3 ml | 1 ml |
| FORMULA | *Althea officinalis* | | | | 5 ml |
| | *Thymus vulgaris* | | | | 4 ml |
| | *Salvia officinalis* | | | | 4 ml |
| | | 0.065-0.975 ml | 0.65 ml | 1.3-19.5 ml | 13 ml |
| FORMULA | *Plantago lanceolata* | | | | 5 ml |
| | *Commiphora myrrha* | | | | 5 ml |
| | *Drosera* spp. | | | | 1 ml |
| | Ephedra (Ma Huang 1:4 Ø) | | | | 3 ml |
| | | 0.07-1.05 ml | 0.7 ml | 1.4-21 ml | 14 ml |
| | *Humulus lupulus* | 25-150 mg | 100 mg | 500-3000 mg | 2000 mg |
| | *Piper methysticum* Standardized Extract (30%-70% kavalactones) | 5-35 mg | 15 mg | 100-700 mg | 300 mg |
| | *Passiflora incarnata* | 0.025-0.15 ml | 0.1 ml | 0.5-3 ml | 2 ml |
| | *Valeriana* species | 0.1-0.5 ml | 0.25 ml | 2-10 ml/2 hours | 5 ml |
| | *Avena sativa* | 0.05-0.25 ml | 0.15 ml | 1-5 ml | 3 ml |
| FORMULA | *Humulus lupulus* | | | | 250 mg |
| | *Piper methysticum* | | | | 350 mg |
| | *Passiflora incarnata* | | | | 250 mg |
| | *Valeriana* species | | | | 500 mg |
| | *Avena sativa* | | | | 500 mg |
| | Melatonin | | | | 3 mg |
| | | 9.27-138.98 mg | 92.65 mg | 185.3-2779.5 mg | 1853 mg |
| FORMULA | *Piper methysticum* Standardized Extract (30%-70% kavalactones) | | | | 300 mg |
| | Valerian | | | | 1000 mg |
| | gamma-Aminobutyric Acid | | | | 1500 mg |
| | | 14-210 mg | 140 mg | 280-4200 mg | 2800 mg |
| | *Turnera diffusa* | 0.1-0.6 ml | 0.2 ml | 2-12 ml | 4 ml |
| | *Serenoa serrulata* | 0.025-0.15 g | 0.075 g | 0.5-3 g | 1.5 g |
| FORMULA | *Turnera diffusa* | | | | 4 ml |
| | *Serenoa serrulata* | | | | 5 ml |
| | *Avena sativa* | | | | 3 ml |
| | | 0.06-0.9 ml | 0.6 ml | 1.2-18 ml | 12 ml |
| | *Panax* Ginseng | 0.5-150 mg | 37.5 mg | 10-3000 mg | 750 mg |
| | *Panax Quinefollium* | 0.5-100 mg | 25 mg | 10-2000 mg | 500 mg |
| | *Eleutherococcus senticosus* | 0.5-200 mg | 50 mg | 10-4000 mg | 1000 mg |
| | *Centella asiatica* | 0.5-50 mg | 30 mg | 10-1000 mg | 600 mg |
| | *Paullina guarana* | 2.5-10 mg | 10 mg | 50-200 mg | 200 mg |
| | *Schisandra chinesis* | 0.5-50 mg | 25 mg | 10-1000 mg | 500 mg |
| | *Pfaffia paniculata* | 0.025-0.225 g | 0.15 g | 0.5-4.5 g | 3 g |
| FORMULA | *Panax* Ginseng | | | | 750 mg |
| | *Centella asiatica* | | | | 500 mg |
| | *Paullina guarana* | | | | 100 mg |
| | *Schisandra chinesis* | | | | 250 mg |
| | *Pfaffia paniculata* | | | | 500 mg |
| | Epigallocatechin gallate (EGCg) | | | | 500 mg |
| | | 11.75-176.25 mg | 117.5 mg | 235-3525 mg | 2350 mg |
| | Thiamine hydrochloride | 0.05-5 mg | 5 mg | 1-100 mg | 100 mg |
| | Riboflavin | 0.05-5 mg | 5 mg | 1-100 mg | 100 mg |
| | Nicotinamide or Niacinamide | 0.05-5 mg | 5 mg | 1-100 mg | 100 mg |
| | Nicotinic acid or Niacin | 0.05-5 mg | 5 mg | 1-100 mg | 100 mg |
| | Pantothenic acid | 0.05-5 mg | 5 mg | 1-100 mg | 100 mg |
| | Calcium d-Pantothenate | 0.05-5 mg | 5 mg | 1-100 mg | 100 mg |
| | Pyridoxine hydrochloride | 0.05-5 mg | 5 mg | 1-100 mg | 100 mg |
| | Cyanocobalamin | 0.75-50 mcg | 5 mcg | 15-1000 mcg | 100 mcg |
| | Pangamic acid | 0.05-25 mg | 15 mg | 1-500 mg | 300 mg |
| | Biotin | 0.05-15 mcg | 15 mcg | 1-300 mcg | 300 mcg |
| | Choline | 0.25-25 mg | 12.5 mg | 5-500 mg | 250 mg |
| | Inositol | 0.05-750 mg | 12.5 mg | 1-1500 mg | 250 mg |
| | Para-amino benzoic acid | 0.05-50 mg | 5 mg | 1-1000 mg | 100 mg |
| | Phosphatidyl Choline | 5-200 mg | 50 mg | 100-4000 mg | 1000 mg |
| | Lecithin | 5-200 mg | 50 mg | 100-4000 mg | 1000 mg |
| FORMULA | Retinol palmitate | | | | 1.5 mg |
| | Thiamine hydrochloride | | | | 10 mg |

TABLE 1-continued

| | Name/Substance/ Compound/Active Ingredient | A | B | C | D |
|---|---|---|---|---|---|
| | Riboflavin | | | | 5 mg |
| | Nicotinamide or Niacinamide | | | | 50 mg |
| | Pantothenic acid | | | | 15 mg |
| | Calcium d-Pantothenate | | | | 15 mg |
| | Pyridoxine hydrochloride | | | | 10 mg |
| | Cyanocobalamin | | | | 50 mcg |
| | Folic acid or Folacin | | | | 400 mcg |
| | Biotin | | | | 100 mcg |
| | Choline | | | | 250 mg |
| | Inositol | | | | 250 mg |
| | Para-amino benzoic acid | | | | 100 mg |
| | Ascorbic acid | | | | 1000 mg |
| | Cholecalciferol | | | | 5 mcg |
| | d-alpha Tocopheryl acetate | | | | 2.5 mcg |
| | | 8.54-128.03 | 85.35 mg | 170.70-2560.59 mg | 1707.06 mg |
| FORMULA | Epigallocatechin gallate (EGCg) | | | | 500 mg |
| | Endostatin | | | | 300 mg |
| | epicatechin gallate (ECG) | | | | 2700 mg |
| | | 35-227.5 mg | 175 mg | 700-4550 mg | 3500 mg |
| FORMULA | Epigallocatechin gallate (EGCg) | | | | 500 mg |
| | Lovastatin | | | | 80 mg |
| | epicatechin gallate (ECG) | | | | 2700 mg |
| | | 32.5-213 mg | 164 mg | 650-4260 mg | 3280 mg |
| FORMULA | Epigallocatechin gallate (EGCg) | | | | 500 mg |
| | Lodine XL | | | | 1000 mg |
| | epicatechin gallate (ECG) | | | | 2700 mg |
| | | 42-273 mg | 210 mg | 840-5460 mg | 4200 mg |
| FORMULA | Epigallocatechin gallate (EGCg) | | | | 500 mg |
| | Curcumin | | | | 750 mg |
| | epicatechin gallate (ECG) | | | | 3000 mg |
| | | 42.5-275 mg | 212.5 mg | 850-5500 mg | 4250 mg |
| FORMULA | Epigallocatechin gallate (EGCg) | | | | 500 mg |
| | Tamoxifen | | | | 20 mg |
| | epicatechin gallate (ECG) | | | | 3000 mg |
| | | 42.5-275 mg | 212.5 mg | 850-5500 mg | 4250 mg |
| FORMULA | Epigallocatechin gallate (EGCg) | | | | 500 mg |
| | Selenium | | | | 0.2 mg |
| | Lycopene | | | | 10 mg |
| | epicatechin gallate (ECG) | | | | 3000 mg |
| | | 35-228 mg | 175.51 mg | 700-4560 mg | 3510.2 mg |

TABLE 2

| | UNIT DOSAGE | | | | |
|---|---|---|---|---|---|
| | Name/Substance/ Compound/Active Ingredient | A | B | C | D | E |
| | Acetylsalycilic acid | | | 0.3-4 g | 250 mg | |
| | Paracetamol | | | 0.5-4 g | 0.5 g | |
| | Ibuprofen | | | 0.6-1.2 g | 200 mg | |
| | Indomethacin | | | 50-150 mg | 25 mg | |
| | Mefenamic acid | | | 500-1500 mg | 250 mg | |
| | Naproxen | | | 250-750 mg | 250 mg | |
| | Codeine Phosphate | | | 10-60 mg | 5 mg | |
| | dl-Phenylalanine | | | 500-1500 mg | 500 mg | |
| | *Salix alba* | | | 1000-2000 mg | 250 mg | |
| | *Tanacetum parnethium* | | | 250-1500 mg | 250 mg | |
| | Paracetamol | | | 2000 mg | 500 mg | |
| | Codeine Phosphate | | | 20 mg | 5 mg | |
| | Clomipramine HCl | | | 10-75 mg | 25 mg | |
| | Nortriptyline HCl | | | 25-100 mg | 25 mg | |
| | Imipramine HCl | | | 75-150 mg | 25 mg | |
| | Dothepin HCl | | | 25-75 mg | 25 mg | |
| | Trimipramine HCl | | | 50-100 mg | 50 mg | |
| | Mianserin HCl | | | 30-90 mg | 10 mg | |
| | Fluoxetine HCl | | | 20-80 mg | 20 mg | |
| | Paroxetine HCl | | | 10-50 mg | 10 mg | |

TABLE 2-continued

| | Name/Substance/ Compound/Active Ingredient | UNIT DOSAGE A | B | C | D | E |
|---|---|---|---|---|---|---|
| | Citalopram hydrobromide | | | 20 mg | 20 mg | |
| | Sertraline HCl | | | 50-200 mg | 50 mg | |
| | Verilafaxine HCl | | | 37.5-75 mg | 37.5 mg | |
| FORMULA | *Hypericum perfoliatum* (as standarized extract of 0.3% Hypericin) | | | 50-900 mg | 300 mg | |
| | 5-Hydroxy-tryptophan | | | 10-150 mg | 50 mg | |
| | (as seed extract of *Griffonia simplificolia*) | | | | | |
| | | | | | 350 mg | 35-1050 mg |
| FORMULA | *Hypericum perfoliatum* (as standarized extract of 0.3% Hypericin) | | | 50-900 mg | 300 mg | |
| | *Eleutherococcus senticosus* | | | 200-3000 mg | 1000 mg | |
| | | | | | 1300 mg | 130-3900 mg |
| FORMULA | *Rhodiola rosea* | | | 50-1000 mg | 250 mg | |
| | 5-Hydroxy-tryptophan (as seed extract of *Griffonia simplificolia*) | | | 100 mg | 50 mg | |
| | *Panax* Ginseng | | | 0.5-3 g | 1000 mg | |
| | | | | | 1300 mg | 130-5200 mg |
| | Promethazine HCl | | | 10-100 mg | 5 mg | |
| | Dexchlorpheneramine mal. | | | 2-8 mg | 1 mg | |
| | Mepyramine maleate | | | 25-100 mg | 5 mg | |
| | Prednisone | | | 5-20 mg | 1 mg | |
| | Betamethasone | | | 0.5-4.5 mg | 0.1 mg | |

| | | |
|---|---|---|
| Propanolol HCl | 10-480 mg | 10 mg |
| Atenelol HCl | 50-100 mg | 50 mg |
| Sotalol Hcl | 160-320 mg | 80 mg |
| Captopril | 25-150 mg | 10 mg |
| Enalapril maleate | 2.5-20 mg | 2.5 mg |
| Losartan | 5-20 mg | 1 mg |
| Verapamil HCl | 40-360 mg | 20 mg |
| Nifedipine | 20-40 mg | 5 mg |
| Glibenclamide | 2.5-15 mg | 5 mg |
| Chlorpropramide | 100-500 mg | 100 mg |
| Gliclazide | 80-320 mg | 80 mg |
| Metformin HCl | 0.5 g-3 g | 250 mg |
| Salbutamol | 200-1600 mcg | 200 mcg |
| Fenoterol HBr | 2.5 mg-15 mg | 2.5 mg |
| Hexoprenaline | 0.5 mg-1.5 mg | 0.5 mg |
| Amoxicillin trihydrate | 750-1500 mg | 250 mg |
| Ampicillin trihydrate | 1000-2000 mg | 250 mg |
| Cloxacillin sodium | 500-2000 mg | 500 mg |
| Cephradine | 1000-2000 mg | 250 mg |
| Cephalexin monohydrate | 1000-4000 mg | 250 mg |
| Cefaclor | 750-1500 mg | 375 mg |
| Cefpodoxime | 200-400 mg | 100 mg |
| Erythromycin stearate | 1000-4000 mg | 250 mg |
| Ibuprofen | 0.6-1.2 g | 200 mg |
| Indomethacin | 50-150 mg | 25 mg |
| Mefenamic acid | 500-1500 mg | 250 mg |
| Naproxen | 250-750 mg | 250 mg |
| Acetylsalycillic acid | 0.3-4 g | 250 mg |

The invention claimed is:

1. A smoker's requisite, comprising a carrier and a natural product, either alone or in combination with one or more of the following:

a pharmaceutical product; and a food supplement, wherein the natural product includes a prenyl flavonoid which is selected from any one, or any combination of the following: prenylchalcones, prenylflavonones, 2-hydroxy-2-methylbut-3-ene and xanthohumol;

the natural product being embodied in the carrier such that, when the requisite is lit and smoked by a smoker, a quantity of the natural product is ingested by the smoker.

2. The smoker's requisite according to claim 1, wherein the carrier is in the form of any one of the following: a package, a cartidge, a filter, a membrane, a pill, a sponge, a matrix, a tablet and a string.

3. The smoker's requisite according to claim 1, wherein the pharmaceutical product is selected from any one, or any combination of the following anti-carcinogenic substances: tofenacin, traodone, viloxazine, interferon, thalidomide, Col-3, tamoxifen, thymidylate synthase inhibitors, COX2 inhibitors, celebrex, rofecoxib (vioxx), imatinib mesylate, gleevec (STI 571) and cyproheptadine.

4. The smoker's requisite according to claim 1, wherein the food supplement is selected from any one, or any combination of the following: a calcium supplement, a tonic and a stimulant.

5. The smoker's requisite according to claim 1, wherein the natural product further comprises a plant substance obtained from *camellia sinensis*.

6. The smoker's requisite according to claim 1, wherein the natural product further comprises *epigallocatechin gallate* and the food supplement includes curcumin.

7. The smoker's requisite according to claim 1 wherein, the natural product further comprises a natural anti-carcinogen of the type found in any one, or any combination of the following: catsclaw, olive leaf, olive leaf extract, pau-d'arco, mistletoe, cartilage including shark cartilage, alfalfa, onions, spinach, broccoli, kale, garlic, red bell peppers and beets, fruits, red grapes, white grapes, oranges, strawberries, kiwi fruit, grapefruit, pink grapefruit, tomatoes, apples, *camellia sinensis* and cocoa.

8. The smoker's requisite according to claim 1, wherein the natural product further comprises a plant substance selected from any one, or any combination of the following: echinacea, ambrosia, marijuana/cannabis, hemp and alfalfa.

9. The smoker's requisite according to claim 1, wherein the natural product further comprises a substance selected from any one, or any combination of the following: tocopherol, alpha-tocopherol, beta-carotene, retinoic acid and ascorbic acid.

10. The smoker's requisite according to claim 1, wherein the prenyl flavonoid is selected from the group consisting of prenylchalcones, prenylflavonones, 2-hydroxy-2-methyl-but-3-ene and xanthohumol.

11. The smoker's requisite according to claim 1, wherein the natural product further comprises grapefruit seed extract.

12. A smoker's requisite, comprising:

i) a carrier; and ii) a natural product selected from the group consisting of prenylchalcones, prenyiflavonones, 2-hydroxy-2-methylbut-3-ene and xanthohumol, and combinations thereof, and wherein the natural product is present in the carrier so that when the smoker's requisite is lit and smoked by a smoker, a quantity of the natural product is ingested by the smoker.

13. The smoker's requisite according to claim 12, wherein the carrier is in the form selected from the group consisting of a package, a cartridge, a filter, a membrane, a pill, a sponge, a matrix, a tablet and a string.

14. The smoker's requisite according to claim 12, further comprising a pharmaceutical product selected from the group consisting of tofenacin, traodone, viloxazine, interferon, thalidomide, Col-3, tamoxifen, thymidylate synthase inhibitors, COX-2 inhibitors, celebrex, rofecoxib (vioxx), imatinib mesylate, gleevec (STI 571), cyproheptadine and combinations thereof.

15. The smoker's requisite according to claim 12 wherein, the natural product further comprises a natural anti-carcinogen selected from the group consisting of catsclaw, olive leaf, olive leaf extract, pau-d'arco, mistletoe, cartilage including shark cartilage, alfalfa, onions, spinach, broccoli, kale, garlic, red bell peppers, beets, fruits, red grapes, white grapes, oranges, strawberries, kiwi fruit, grapefruit, pink grapefruit, tomatoes, apples, *camellia sinensis*, cocoa, and combinations thereof.

16. The smoker's requisite according to claim 12, wherein the natural product is selected from the group consisting of tocopherol, aipha-tocopherol, beta-carotene, retinoic acid, ascorbic acid, and combinations thereof.

17. The smoker's requisite according to claim 12, wherein the natural product is selected from the group consisting of prenylchalcones, prenylfiavonones, 2-hydroxy-2-methyl-but-3-ene and xanthohumol.

* * * * *